US012270095B2

(12) United States Patent
Luo et al.

(10) Patent No.: US 12,270,095 B2
(45) Date of Patent: Apr. 8, 2025

(54) ANTI-OXIDATION HEAT-RESISTANT ALLOY AND PREPARATION METHOD

(71) Applicant: QINGDAO NPA INDUSTRY CO., LTD., Pingdu (CN)

(72) Inventors: Heli Luo, Beijing (CN); Xinglei Wang, Pingdu (CN); Shangping Li, Beijing (CN); Zhaoxiong Gu, Pingdu (CN); Jiantao Wang, Beijing (CN); Lijuan Wei, Pingdu (CN); Fajie Yin, Beijing (CN); Zhenhua Wang, Pingdu (CN)

(73) Assignee: QINGDAO NPA INDUSTRY CO., LTD., Pingdu (CN)

( * ) Notice: Subject to any disclaimer, the term of this patent is extended or adjusted under 35 U.S.C. 154(b) by 754 days.

(21) Appl. No.: 17/291,151

(22) PCT Filed: Sep. 12, 2019

(86) PCT No.: PCT/CN2019/105531
§ 371 (c)(1),
(2) Date: May 4, 2021

(87) PCT Pub. No.: WO2020/093783
PCT Pub. Date: May 14, 2020

(65) Prior Publication Data

US 2022/0018005 A1 Jan. 20, 2022

(30) Foreign Application Priority Data

Nov. 8, 2018 (CN) ..... 201811324651.0

(51) Int. Cl.
*C22C 38/50* (2006.01)
*C22C 1/02* (2006.01)
(Continued)

(52) U.S. Cl.
CPC ..... *C22C 38/50* (2013.01); *C22C 1/02* (2013.01); *C22C 38/005* (2013.01); *C22C 38/06* (2013.01);
(Continued)

(58) Field of Classification Search
None
See application file for complete search history.

(56) References Cited

U.S. PATENT DOCUMENTS

2015/0354358 A1 12/2015 Grande, III et al.

FOREIGN PATENT DOCUMENTS

CN 109112327 A 1/2019
EP 0639654 A2 2/1995
(Continued)

OTHER PUBLICATIONS

International Search Report, mailed Dec. 5, 2019, issued in corresponding PCT application No. PCT/CN2019/105531, filed Sep. 12, 2019.

*Primary Examiner* — Anthony M Liang
(74) *Attorney, Agent, or Firm* — PERRY + CURRIER INC.

(57) ABSTRACT

The present disclosure relates to an oxidation-resistant heat-resistant alloy and a preparing method. The oxidation-resistant heat-resistant alloy of the present disclosure, by mass percentage, includes: 2.5%-6% of Al, 24%-30% of Cr, 0.3%-0.55% of C, 30%-50% of Ni, 2%-8% of W, 0.01%-0.2% of Ti, 0.01%-0.2% of Zr, 0.01%-0.4% of Hf, 0.01%-0.2% of Y, 0.01%-0.2% of V, N<0.05%, O<0.003%, S<0.003%, and Si<0.5%, the balance being Fe and inevitable impurities; wherein merely one of Ti and V is comprised. The method for preparing the oxidation-resistant heat-resistant alloy includes: smelting with inactive element
(Continued)

materials→refining→adding mixed rare earth→adding slag→alloying active elements.

4 Claims, 4 Drawing Sheets

(51) Int. Cl.

| | |
|---|---|
| ***C22C 38/00*** | (2006.01) |
| ***C22C 38/06*** | (2006.01) |
| ***C22C 38/44*** | (2006.01) |
| ***C22C 38/46*** | (2006.01) |
| ***C23C 8/06*** | (2006.01) |

(52) U.S. Cl.
CPC ..... *C22C 38/44* (2013.01); *C22C 38/46* (2013.01); *C23C 8/06* (2013.01)

(56) References Cited

FOREIGN PATENT DOCUMENTS

| | | | |
|---|---|---|---|
| EP | 0639654 | A3 | 2/1995 |
| EP | 1647606 | A1 | 4/2006 |
| EP | 2206796 | A1 | 7/2010 |
| GB | 2394959 | A | 5/2004 |
| JP | 06207235 | A | 7/1994 |
| JP | H09243284 | A | 9/1997 |
| JP | 2005133107 | A | 5/2005 |
| JP | 2004107777 | A | 4/2008 |
| JP | 2018075606 | A | 5/2018 |
| MX | 2011003923 | A | 5/2011 |
| SU | 1713962 | A1 | 2/1992 |
| WO | WO-2005078148 | A1 | 8/2005 |

ANTI-OXIDATION HEAT-RESISTANT ALLOY AND PREPARATION METHOD

CROSS-REFERENCE TO RELATED APPLICATIONS

This application is a National Stage of International Application PCT/CN2019/105531, filed Sep. 12, 2019, which claims priority to Chinese Patent Application No. 201811324651.0, filed Nov. 8, 2018, both of which are hereby incorporated by reference in their entireties.

TECHNICAL FIELD

The present disclosure relates to the technical field of alloys, and particularly relates to an oxidation-resistant heat-resistant alloy and a preparing method.

BACKGROUND ART

Along with the development in the fields such as aviation and petrochemistry, materials that have an excellent high-temperature oxidation resistance at 1000-1200° C. are stringently needed, such as high-temperature components for the combustion chambers and tailpipes of aircraft engines and ethylene cracking furnace tubes. Furthermore, in order to realize the connection of components, the materials are required to have a good weldability. Actively serving materials of those components are mostly wrought superalloys and heat-resistant steels, which have a good weldability. However, the high-temperature oxidation resistance of the alloys is realized mainly by adding a high content of Cr, and the oxidation film formed at high temperature is mainly $Cr_2O_3$. $Cr_2O_3$ at below 1000° C. is very stable, and has a good protection function, but at above 1000° C. is not stable, easily gasifies to form holes, and loses the protection function to the alloy matrix. $Al_2O_3$ can maintain stable in high-temperature environments at above 1000° C. Therefore, in order to enable the alloys to have an excellent oxidation resistance at above 1000° C., it is required to form a compact $Al_2O_3$ film, and if the area of the $Al_2O_3$ in the oxidation film formed at the surface of the alloys is larger, the oxidation film is more difficult to peel, and the oxidation resistance of the alloys is better.

By adding a certain amount of aluminum into heat-resistant steels, an $Al_2O_3$ film can be formed, which obviously improves the high-temperature oxidation resistance of the alloys. In the field of petrochemistry, ethylene cracking tubes have already begun employing aluminiferous heat-resistant alloys to replace traditional heat-resistant steels, in which the HTE alloy (ZL102187003B) developed by the Schmidt-Clemens company in Germany is the most representative and has the optimal performance. The ethylene cracking furnace tubes made from the HTE alloy have good oxidation resistance and coking resistance, and both of the furnace tube life and the decoking period are greatly improved compared with the traditional heat-resistant steels. However, the high-temperature mechanical property, oxidation resistance and oxidation film stability of the alloy can still be further improved.

Furthermore, when the aluminum content is high, an $Al_2O_3$ layer having a sufficient thickness can be generated, thereby preventing the generated $Al_2O_3$ layer from peeling in service at high temperature. However, if the aluminum content is too high, the toughness of the alloys is poor.

Therefore, in service at high temperature, good oxidation resistance and good toughness of the alloys cannot be simultaneously obtained.

As different from heat-resistant steels, when active elements such as aluminum and titanium are added, they easily form oxide and nitride inclusions with the oxygen and nitrogen in the alloys, which affects the mechanical property of the alloys, and consume the principal elements such as aluminum and titanium, which affects the formation of the aluminum-oxide film. Therefore, in order to realize high-quality preparation and ensure an excellent service property, it is required to strictly control the oxygen and nitrogen contents of the aluminum-containing alloys. Furthermore, sulfur heavily influences the adhesion between the oxidation film and the alloy matrix, and in order to ensure that the oxidation film can stably adhere to the surface of the alloy matrix to have the protection function, it is required to strictly control the sulfur content in the alloys. However, as restricted by the preparation process, in the preparation process of the conventional aluminum-containing alloys, the range within which the harmful element nitrogen is controlled is too wide, and the harmful elements such as oxygen and sulfur are not controlled, which seriously affects the performance and quality stability of the furnace tubes.

Regarding the technical field of alloys, it is relatively easy to improve the comprehensive property of alloys at below 1050° C., but to improve the property of alloys at the service temperature above 1050° C., especially the comprehensive property when it is approaching 1200° C., is a big problem in the field. Just because it is so difficult to improve the property of alloys at high service temperature, at above 1050° C., even if the service temperature of the alloys is intended to be increased by only 50° C., the difficulty will be of an exponential order, and the labor that is required to pay will be unthinkable to a person skilled in the art. The increasing by only 50° C. is an unignorable achievement, and should be commonly acknowledged and respected by an expert of the industry.

SUMMARY OF THE INVENTION

In view of the above-described analysis, the present disclosure aims at providing an oxidation-resistant heat-resistant alloy and a preparing method, which can solve at least one of the following technical problems:

(1) When the service temperature is above 1100° C., good oxidation resistance and good mechanical property of the alloys cannot be simultaneously obtained;

(2) The harmful elements such as oxygen, sulfur and nitrogen are not effectively controlled, which causes the alloys to have a poor comprehensive property and an instable quality; and (3) The proportion of the $Al_2O_3$ film in the oxidation film formed at the surface of the alloys in the high-temperature environments at above 1100° C. is low, and the $Al_2O_3$ film easily peels, which results in a poor oxidation resistance of the alloys.

An object of the present disclosure is realized mainly by the following technical solution:

In an aspect, the present disclosure provides an oxidation-resistant heat-resistant alloy, by mass percentage, the alloy comprises: 2.5%-6% of Al, 30%-50% of Ni, 2%-8% of W and 0.01%-0.4% of Hf.

On the basis of the above solution, the present disclosure is improved as follows:

Optionally, the alloy comprises: 2.5%-6% of Al, 24%-30% of Cr, 0.3%-0.55% of C, 30%-50% of Ni, 2%-8% of W, 0.01%-0.2% of Ti, 0.01%-0.2% of Zr, 0.01%-0.4% of Hf, 0.01%-0.2% of Y, and 0.01%-0.2% of V; wherein merely one of Ti and V is comprised.

Optionally, the alloy comprises: N<0.05%, O<0.003%, S<0.003%, and Si<0.5%, the balance being Fe and inevitable impurities.

Optionally, the alloy comprises: 3.3%-5.5% of Al, and 34%-46% of Ni.

Optionally, the alloy comprises: 3%-6% of W.

Optionally, the alloy comprises: 0.01%-0.06% of Y.

Optionally, in an oxidizing atmosphere of 1000-1200° C., no less than 90% of an area of an oxidation film that is formed at a surface of the alloy is an $Al_2O_3$ film.

In another aspect, the present disclosure further provides a method for preparing an oxidation-resistant heat-resistant alloy, which comprises the following steps:

Step 1: melting carbon and the inactive elements, to obtain a molten steel after being completely molten;

Step 2: heating up the molten steel, and refining;

Step 3: adding a mixed rare earth;

Step 4: adding a slag; and

Step 5: introducing an inert gas into a casting runner, placing active elements such as aluminum, hafnium, titanium, zirconium and yttrium in the casting runner, heating up, pouring the molten steel into the casting runner, and introducing the molten steel into a tundish to cast.

Optionally, a temperature of the refining in Step 2 is not less than 1640° C.

Optionally, part of the carbon is firstly added in Step 1, and remaining carbon is then added in Step 2 when the molten steel has been heated to no less than 1640° C.

Optionally, the addition amount of the mixed rare earth is 0.05%-0.25% of the mass of the molten steel.

Optionally, the slag contains CaO.

Optionally, the inert gas is argon, the pressure of the argon is 0.15-0.3 MPa, and the flow rate is 1-5 L/min.

Optionally, the method further comprises casting after Step 5, and the speed from the steel tapping to the completion of the casting is 60-100 kg/minute.

The advantageous effects of the present disclosure are as follows:

(1) The present disclosure, by adding a proper amount of Al element, ensures the formation of $Al_2O_3$ film, and the weldability and the mechanical property can be simultaneously obtained; by adding a proper amount of C element, ensures precipitating carbide which is used to strengthen alloy; by adding a proper amount of Cr element, facilitates forming $Al_2O_3$ film in a low aluminum content, and forming carbide which is used to strengthen alloy; by adding a proper amount of Zr element, strengthens the grain boundary, to improve the mechanical property; and by adding a proper amount of Ti or V element, thins the carbide, to improve the creep property of the alloy.

(2) The present disclosure, by comprehensively adjusting the Ni content and the Al content, reduces the formation of $Ni_3Al$ phase, to enable the alloy to still have a good toughness when the Al content is above 4%.

(3) The present disclosure, by adding Hf, and by the combined function of Hf and Y, when the Y content is below 0.06%, can still optimize the morphology and chemical composition of the oxide and alleviate the degree of internal oxidation, to enable the oxidation film formed at the surface of the alloy to be continuous and compact, to improve the cohesion between the oxidation film and the matrix, and in turn greatly improve the high-temperature oxidation resistance of the alloy.

(4) The present disclosure, by adding W, and by controlling the W content, improves the high-temperature strength of the alloy, and prolongs the service life.

(5) It is very difficult to improve the property of the alloy at above 1050° C., especially the property when it is approaching 1200° C., and each time the temperature is improved by 20° C. or 50° C., the increasing of such difficulty will be of exponential order, which absolutely cannot be obtained or realized by limited experimentation or according to conventional choice. In fact, the present disclosure adjusts the composition and contents of the element via a high quantity of experimentation, to enable the alloy to form a stable $Al_2O_3$ film in the high-temperature environment of 1100-1200° C. The alloy has an excellent oxidation resistance, a good high-temperature strength and a good welding performance, and its comprehensive performance is superior to the conventional aluminum-containing heat-resistant alloy.

(6) The preparation method provided by the present disclosure, by adding the carbon in different batches, realizes multi-time and deep deoxidation and denitrification, thereby effectively reducing the N and O contents in the alloy, and in turn improving the property of the alloy.

(7) The present disclosure, by adding the mixed rare earth multiple times rather than adding all in one time, reduces the oxidation and burning loss of the rare earth, to ensure that the rare earth can be effectively added; and by controlling the addition amount of the mixed rare earth, can ensure a good desulfurization effect, and prevent the rare earth elements remaining in the molten steel from forming a low-melting-point phase with Ni, and affecting the high-temperature mechanical property of the alloy.

(8) The present disclosure, by selecting the type of the covering slag and controlling the addition amount of the covering slag, adsorbs and catches the floating oxides, nitrides, sulfides and inclusions, thereby obtaining a molten steel of a high cleanliness.

(9) The present disclosure, by controlling the refining temperature to be not less than 1640° C., enables the chemical reaction of the generation of CO by the replacement reaction between carbon and the oxide inclusions in the molten steel to be more easily performed, to obtain a better purifying effect.

(10) The present disclosure, by adjusting the process steps and the process parameters, enables the N content in the alloy that is prepared by the preparation method of the present disclosure to be below 0.05%, the O content below 0.003%, the S content below 0.003%, and the Si content below 0.5%.

In the present disclosure, the above technical solutions may be intercombined, to realize more preferable combined solutions. The other characteristics and advantages of the present disclosure will be described below in the description, and part of the advantages can become apparent from the description, or become apparent in the implementation of the present disclosure. The objects and other advantages of the present disclosure can be implemented and obtained from the contents that are particularly pointed out in the description and the claims.

BRIEF DESCRIPTION OF DRAWINGS

The drawings are merely for the purpose of illustrating the particular embodiments, and are not considered as limitation to the present disclosure. Throughout the drawings, the same reference signs denote the same elements.

DETAILED DESCRIPTION OF THE INVENTION

Figure 1:
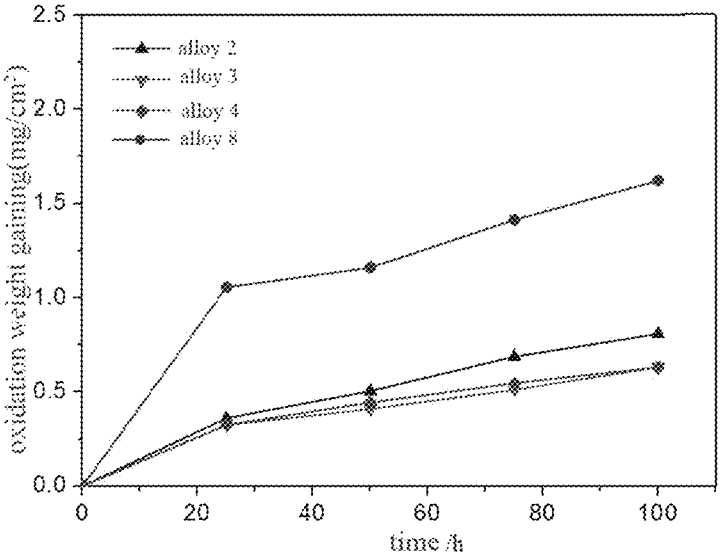
FIG. 1 is the cyclic-oxidation weight-gaining curves at 1100° C. of the alloys of embodiments of the present disclosure and the comparative material No. 8 alloy.

The preferable embodiments of the present disclosure will be particularly described below with reference to the drawings. The drawings form a portion of the present disclosure, are for explaining the principle of the present disclosure together with the embodiments of the present disclosure, and are not intended to limit the scope of the present disclosure.

In the present disclosure, unless indicated otherwise, all of the contents refer to mass percentage contents. The functions of the elements in the iron-nickel-based high-temperature oxidation-resistant heat-resistant alloy of the present disclosure are described in detail as follows:

Ni: Ni can stabilize austenite structure, and expand austenite phase regions, to enable the alloy to have high strength and plastic matching, and ensure that the alloy has good high-temperature strength and creep resistance. However, a too high Ni content affects the solubility of nitrogen in the matrix, aggravates the tendency of precipitation of the nitrides in the alloy, and affects the creep strength of the alloy. Furthermore, Ni of a too high content easily forms $Ni_3Al$ phase with the Al in the alloy. And the $Ni_3Al$ phase affects the toughness and machining property of the alloy. If the Ni content is above 60%, even if the Al content is controlled to be below 4%, $Ni_3Al$ phase will be formed, which affects the toughness and machining property of the alloy. Furthermore, Ni element has a high cost, and a too high content will affect the preparation cost of the alloy. Therefore, the content of the Ni in the material of the present disclosure is controlled to be 30%-50%, preferably 34%-46%.

Al: Al is a requisite element for the formation of a high-stability $Al_2O_3$ film at the surface when the alloy is high-temperature oxidized. However, if the content of Al element is too high, it easily forms with Ni an intermetallic compound $Ni_3Al$ phase, and the $Ni_3Al$ phase can improve the strength of the alloy, and is adverse to the toughness and the machinability. When the temperature is above 1000° C., the $Ni_3Al$ phase is re-dissolved and disappears, so it is not beneficial for the high-temperature strength and service life of the alloy. At medium and low temperatures, the existing of $Ni_3Al$ improves the strength of the alloy, but the improving of room-temperature or medium-low-temperature strengths is not beneficial for the service of the alloy, and the declining of the room-temperature toughness and the declining of the machinability will seriously affect the casting and processing cost of the components. Therefore, for the present disclosure, it is required to, by jointly adjusting and controlling the Ni content and the Al content, prevent forming $Ni_3Al$ phase. Because the Ni content in the present disclosure is not high, when the Al content is above 4%, $Ni_3Al$ phase still has not been formed. At the same time, in order to form a stable $Al_2O_3$ film at higher temperatures, the content of the Al in the present disclosure is controlled to be 2.5%-6%, preferably 3.3%-5.5%.

Cr: in the present disclosure, the addition of Cr can reduce the critical value of the Al amount for the formation of an $Al_2O_3$ film, and the addition of Cr enables the Al amount for the formation of an $Al_2O_3$ film layer at the surface of the alloy to decrease, thereby facilitating the formation of the $Al_2O_3$ protection layer. Furthermore, Cr is an element for forming carbides, and the formation of carbides improves the high-temperature strength of the alloy. However, Cr is a strong element for forming ferrites, and a too high addition amount impairs the stability of the austenite phase, which is adverse to the high-temperature strength of the alloy. Therefore, the content of the Cr in the present disclosure should be controlled to be 24%-30%.

C: C is an element for forming carbides, and forms carbide phases in the alloy of the present disclosure. And the carbide phases have the function of dispersion strengthening. If the carbon content is low, the quantity of the carbide phases is low, which affects the effect of the strengthening. If the carbon content is too high, the quantity of the carbide phases is too high, which is adverse to the toughness of the alloy. Therefore, the content of the C in the material of the present disclosure is controlled to be 0.3%-0.55%.

W: W can solid-solve into the alloy matrix to have the function of solid solution strengthening, and form carbides to have the function of dispersion strengthening, which can effectively improve the high-temperature strength of the alloy. However, a too high W content will affect the toughness of the alloy. Therefore, the W content in the present disclosure is controlled to be 2%-8%, preferably 3%-6%.

Ti and V: Ti and V can change the morphology of the grain-boundary carbides, and thin the carbides, to enable it to be uniformly dispersed and distributed, thereby improving the high-temperature creep strength of the alloy. A too high content is adverse to the morphology of the carbides, and easily forms a $Ni_3(Al, Ti)$ phase, which affects the toughness of the alloy. Therefore, the content of the Ti in the present disclosure should be controlled to be 0.01%-0.2%, and the content of the V should be controlled to be 0.01%-0.2%.

Zr: Zr segregates to the grain boundary, and has the function of grain boundary strengthening. However, a too high content easily forms an $Ni_5Zr$ low-melting-point phase, which affects the high-temperature property of the alloy. Therefore, the content of the Zr in the material of the present disclosure should be controlled to be 0.01%-0.2%.

Hf and Y: in the present disclosure, the adding of a proper amount of Hf and Y elements can influence the morphology and chemical composition of the oxides and the degree of internal oxidation, improve the adhesive force of the oxidation film, and greatly improve the high-temperature oxidation resistance of the alloy. When they jointly function, the effect is better. Because the rare earth element Y is very active, in the non-vacuum smelting of the alloy, Y is easily vulnerable to burning loss or oxidation, its content is difficult to effectively control in engineering, and the service stability cannot be ensured. Moreover, Hf is relatively stable, and its content is easily controlled in smelting. In addition, Hf can significantly improve the adhesive force of the oxidation film in high-temperature environments at above 1000° C. However, if the Hf and Y contents are too high, in an aspect, that increases the material cost, and in another aspect, Hf and Y easily form with Ni a low-melting-point phase, which affects the high-temperature mechanical property of the alloy. Therefore, when the material of the present disclosure is added jointly Hf and Y, the content of the Hf is controlled to be 0.01%-0.4%, and the content of the Y is controlled to be 0.01%-0.2%.

Si: Si is easily brought into the alloy by the raw materials such as ferrochromium, and Si facilitates the precipitation of the deleterious σ phase, which reduces the endurance life of the alloy. Therefore, the content of the Si should be strictly controlled, and the present disclosure achieves the purpose of controlling the Si content in the alloy by preferably selecting the raw materials. The content of the Si in the present disclosure is controlled to be below 0.5%.

O and N: because the compositions of the alloy of the present disclosure include active elements such as Al, Hf, Y, Zr and Ti, if the O and N contents are high, inclusions such as oxides and nitrides are easily formed, which harms the toughness of the alloy, and consumes the useful elements such as Al and Hf, which affects the formation of the aluminum-oxide film. Therefore, the O and N contents should be controlled to be low to the largest extent. The content of the O in the alloy of the present disclosure is controlled to be below 0.003%, and the content of the N is controlled to be below 0.05%.

S: S segregates to the grain boundary, which destroys the continuity and stability of the grain boundary, significantly reduces the long-term creep property and tensile plasticity of the alloy, impairs the adhesivity of the surface oxidation film, easily causes oxidation film peeling, and reduces the oxidation resistance of the alloy. Therefore, the content of the S should be controlled to be low to the largest extent, and the content of the S in the alloy of the present disclosure is controlled to be below 0.003%.

The present disclosure provides an oxidation-resistant heat-resistant alloy, by mass percentage, the oxidation-resistant heat-resistant alloy comprises: 2.5%-6% of Al, 24%-30% of Cr, 0.3%-0.55% of C, 30%-50% of Ni, 2%-8% of W, 0.01%-0.2% of Ti, 0.01%-0.2% of Zr, 0.01%-0.4% of Hf, 0.01%-0.2% of Y, and 0.01%-0.2% of V, N<0.05%, O<0.003%, S<0.003%, and Si<0.5%, the balance being Fe and inevitable impurities; wherein merely one of Ti and V is comprised.

Compared with the prior art, the present disclosure, by adjusting the compositions of the alloy and the addition amounts, enables the alloy to have an excellent oxidation resistance, a good high-temperature strength and a good weldability.

Specifically, the advantageous effects of the oxidation-resistant heat-resistant alloy of the present disclosure are as follows:

(1) The present disclosure, by adding a proper amount of Al element, ensures the formation of $Al_2O_3$ film, and the weldability and the mechanical property can be simultaneously obtained; by adding a proper amount of C element, ensures precipitating carbide which is used to strengthen alloy; by adding a proper amount of Cr element, facilitates forming $Al_2O_3$ film in a low aluminum content, and forming carbide which is used to strengthen alloy; by adding a proper amount of Zr element, strengthens the grain boundary, to improve the mechanical property; and by adding a proper amount of Ti or V element, thins the carbide, to improve the creep property of the alloy.

(2) The present disclosure, by comprehensively adjusting the Ni content and the Al content, reduces the formation of $Ni_3Al$ phase, to enable the alloy to still have a good toughness when the Al content is above 4%.

(3) The present disclosure, by adding Hf, and by the combined function of Hf and Y, when the Y content is below 0.06%, can still improve the morphology and chemical composition of the oxide and the degree of internal oxidation, to enable the oxidation film formed at the surface of the alloy to be continuous and compact, to improve the cohesion between the oxidation film and the matrix, and in turn greatly improve the high-temperature oxidation resistance of the alloy.

(4) The present disclosure, by adding W, and by controlling the W content, improves the high-temperature strength of the alloy, and prolongs the service life.

(5) It is very difficult to improve the property of the alloy at above 1050° C., especially the property when it is approaching 1200° C., and each time the temperature is improved by 20° C. or 50° C., the increasing of such difficulty will be of exponential order, which absolutely cannot be obtained or realized by limited experimentation or according to conventional choice. In fact, the present disclosure adjusts the composition and contents of the elements via a high quantity of experimentation, to enable the alloy to form a stable $Al_2O_3$ film in the high-temperature environment of 1100-1200° C. The alloy has an excellent oxidation resistance, a good high-temperature strength and a good welding performance, and its comprehensive performance is superior to the conventional aluminum-containing heat-resistant alloy.

Exemplarily, the composition and mass percentages of the alloy of the present disclosure may also be 4.5%-5.5% of Al, 34%-46% of Ni, 3%-6% of W, and 0.01%-0.06% of Y.

The method for preparing an oxidation-resistant heat-resistant alloy of the present disclosure varies with the use, and if used for the high-temperature components used in the field of aerospace, must employ vacuum-induction melting and casting, and comprises the following steps:

1. preparing materials: selecting electrolytic nickel, metal aluminum, metal chromium (or ferrochromium), pure iron, metal tungsten, graphite, sponge hafnium, sponge titanium, sponge zirconium and metal yttrium as the raw materials, and weighing in proportion them to be used.

2. adding materials: placing the electrolytic nickel, the metal chromium (or ferrochromium), the pure iron and the metal tungsten into the crucible, and adding the other elements from a hopper.

3. smelting: smelting in an intermediate-frequency induction vacuum melting furnace.

supplying power with a small power for 10 minutes to dehydrogenate, then supplying power with a large power to completely melt, and starting refining, wherein the refining temperature is 1530-1580° C., the refining period is set according to the amount of the molten steel, and is controlled to be 10-60 minutes, and during the refining the vacuum degree should be below 5 Pa.

4. casting: after completely melting, stirring with a large power for 1-2 minutes, and pouring when the temperature of the molten steel is controlled to be 1450-1580° C.

preparing the alloy of the present disclosure by using the above vacuum-induction melting method can accurately control active elements such as Al and Y, and can reduce harmful elements such as O, N and S to a very low level. However, the preparation method has a high cost, and the components that are made are limited by the current vacuum furnaces. Therefore, the vacuum casting is only suitable for the precision casting of aerospace castings.

If the method is used for the ethylene cracking furnace tubes of the field of petrochemistry, because the length of a single furnace tube can reach several meters, if both of the smelting and the centrifugal casting are performed in vacuum, it is difficult to implement due to the condition of the equipment, and the cost is too high. Therefore, the smelting and the centrifugal casting can only be performed in non-vacuum environments, but because the raw materials for preparing the alloy of the present disclosure have high contents of the active elements, it is very difficult to prepare qualified alloy in non-vacuum conditions.

The present disclosure further provides a method for preparing the oxidation-resistant heat-resistant alloy in a non-vacuum condition, which comprises the following steps:

Step 1: melting carbon and the inactive elements, to obtain a molten steel after being completely molten;

Step 2: heating up the molten steel to no less than 1640° C. to perform refining;

Step 3: adding a mixed rare earth;

Step 4: adding a slag; and

Step 5: placing active elements such as aluminum, hafnium, titanium, zirconium and yttrium in the casting runner, introducing an inert gas into a casting runner, and when the temperature of the molten steel has risen to 1650-1750° C., pouring the molten steel into the casting runner, and introducing the molten steel into a tundish to perform centrifugal casting.

Compared with the prior art, the advantageous effects of the method for preparing the oxidation-resistant heat-resistant alloy that is provided by the present disclosure are as follows:

(1) By adding the carbon in different batches, the method realizes multi-time and deep deoxidation and denitrification, thereby effectively reducing the N and O contents in the alloy, and in turn improving the property of the alloy.

(2) The present disclosure, by adding the mixed rare earth multiple times rather than adding all in one time, reduces the oxidation and burning loss of the rare earth, to ensure that the rare earth can be effectively added; and by controlling the addition amount of the mixed rare earth, can ensure a good desulfurization effect, and prevent the rare earth elements remaining in the molten steel from forming a low-melting-point phase with Ni, and affecting the high-temperature mechanical property of the alloy.

(3) The present disclosure, by selecting the type of the covering slag and controlling the addition amount of the covering slag, adsorbs and catches the floating oxides, nitrides, sulfides and inclusions, thereby obtaining a molten steel of a high cleanliness.

(4) The present disclosure, by controlling the refining temperature to be not less than 1640° C., enables the chemical reaction of the generation of CO by the replacement reaction between carbon and the oxide inclusions in the molten steel to be more easily performed, to obtain a better purifying effect.

(5) The present disclosure, by adjusting the process steps and the process parameters, enables the N content in the alloy that is prepared by the preparation method of the present disclosure to be below 0.05%, the O content below 0.003%, the S content below 0.003%, and the Si content below 0.5%.

Specifically, by reacting the carbon and the O in the molten steel to generate CO gas, the method, in an aspect, can deoxidize, and, in another aspect, performs air-bubble-carrying denitrification by using the formed CO. By reacting the mixed rare earth and the free O and S in the molten steel to generate oxides or sulfides, the method can desulfurize and further deoxidize.

Considering that elements such as aluminum, hafnium, titanium, zirconium and yttrium are very active, if they are directly melted, they perform chemical reactions with the oxygen in air to generate the oxides, to consume the alloy elements. Therefore, in the preparation method, the active elements are not directly melted. Instead the active elements are placed in a casting runner having inert gas protection, the molten steel obtained after the melting of the inactive elements are poured onto the active elements, the active elements are melted by using the degree of superheat of the molten steel, and the active elements are homogenized in the casting runner by using the kinetic energy of the steel tapping. The above process can effectively reduce the oxidation of the active elements, thereby effectively protecting the alloy elements from being consumed.

In order to reduce the N and O contents in the molten steel to the largest extent, in the preparation method of the present disclosure, the carbon is added stepwisely. That is because, the smelting is performed in air, and in the process of the smelting, oxygen continuously enters the molten steel. In the preparation method, part of carbon is firstly added to preliminarily perform deoxidation and denitrification, the remaining carbon is then added when the molten steel has been heated to no less than 1640° C., and by using that at high temperatures the free energy of CO is lower than those of oxides such as NiO, $Fe_2O_3$ and $Cr_2O_3$, the oxygen that may exist in the oxides is replaced, to perform deep deoxidation, and to protect the alloy elements from being consumed. Furthermore, if too much carbon is added one time, fire and burning loss easily happen, which results in that the carbon cannot effectively enter the molten steel, to affect the effect of deoxidation and denitrification.

In the preparation method, the pouring temperature varies with the casting. Exemplarily, in the casting of a centrifuge tube, high pouring temperatures are in order to ensure that the molten steel has a sufficient fluidity to facilitate the formation of the centrifuge tube. If the centrifuge tube is thinner, the pouring temperature should be higher, and if the temperature is higher, the fluidity of the molten steel is better, but the elements in the molten steel are easier to be buring lost. Therefore, by comprehensively considering the fluidity of the molten steel and the buring loss of the elements, in the casting of the centrifuge tube the temperature is selected to be 1650-1750° C.

In order to prevent the reaction between the molten steel (the alloy melt) and the crucible in the subsequent high-temperature smelting deoxidation, in the preparation method, the crucible is made from aluminum oxide, which has a good high-temperature stability.

It should be noted that, in order to adsorb and catch the floating oxides, nitrides and sulfides, in the preparation method of the present disclosure, a covering slag that contains CaO is added at the surface of the molten steel, which, in an aspect, further desulfurizes by using the CaO, to further remove oxygen, nitrogen and sulfur, and in another aspect, can also effectively remove inclusions, thereby obtaining a molten steel of a high cleanliness.

Specifically, the CaO and S react to perform earlier-stage desulfurization, wherein the reaction equation is: CaO+[S]=CaS+[O], and the reaction process is: firstly desulfurization reaction happens at the surface, the desulfurization generates CaS, which covers the surface of the CaO, after the CaS completely coats the CaO powder, the product layer diffuses inwardly to the desulfurization reaction, and gradually thickens the CaS layer at the surface of the CaO, and the diffusion desulfurization reaction gradually decelerates, till terminates.

Considering that if the addition amount of the slag is too little, it cannot completely cover the surface of the molten steel, and if the addition amount is too much, that causes waste and increases the cost, in the preparation method of the present disclosure, the addition amount of the slag is controlled to be 3%-5% of the mass of the molten steel, which enables the slag to well further remove oxygen, nitrogen and sulfur, and to effectively remove inclusions, thereby obtaining a molten steel of a high cleanliness.

The mixed rare earth that is used in the preparation method of the present disclosure is the mixture of the rare earth elements La and Ce, the addition amount of which is 0.05%-0.25% of the mass of the molten steel. That is because, if the addition amount of the mixed rare earth is too little, the quantity of chemical reactions that are involved in desulfurization is small, obtaining a poor desulfurization effect, and if the addition amount is too much, the rare earth elements remaining in the molten steel easily form a low-melting-point phase with Ni, which affects the high-temperature mechanical property of the alloy. In the preparation method, the addition amount of the mixed rare earth is selected to be 0.05%-0.25% of the mass of the molten steel, which can ensure a good desulfurization effect, and prevent the rare earth elements remaining in the molten steel from forming a low-melting-point phase with Ni, which affects the high-temperature mechanical property of the alloy.

In the preparation method, introducing flowing argon to the top surface of the casting runner forms an argon curtain to protect the molten steel containing the easily oxidized elements, to decelerate its oxidation. Specifically, the pressure of the argon is selected to be 0.15-0.3 MPa, and the flow rate is selected to be 1-5 L/min. That is because, if the argon pressure is too small, it cannot effectively form an argon curtain to isolate air, to prevent the oxidation of the molten steel, and if the argon pressure is too large, that easily causes waste, increases the production cost, and endangers the safety of the operation crews. In the present disclosure, after the molten steel of qualified composition is obtained by using the above method, the process of the centrifugal casting is as follows: The molten steel with qualified composition, a suitable degree of superheat and a suitable weight in the tundish is quickly cast into a metal mold that is rotating at a high speed, and the molten steel is solidified into a centrifugal casting pipe.

Specifically, the alloy obtained by using the preparation method of the present disclosure can, besides being used to cast centrifugal pipes, can also be used to cast other castings that are required to serve at high temperatures, especially castings that are required to serve in severe environments of 1100-1200° C. high temperatures and high oxidability.

Considering that the alloy composition includes a large quantity of active elements, in order to prevent the oxidation burning loss of the active elements, the entire steel tapping operation process is requested to be very quick. Particularly, the speed from the steel tapping to the completion of the casting is controlled to be 60-100 kg/minute.

The chemical composition and contents of the elements of the embodiments of the present disclosure can be seen in Table 1, the process parameters of the preparation methods can be seen in Table 2, the peeling amounts of the alloys after oxidation at different temperatures for 100 h can be seen in Table 3, the contents of the aluminum oxides in the oxidation films of the alloys formed after high-temperature cyclic oxidation at different temperatures can be seen in Table 4, and the endurance lives of the alloys at 1100° C./17 MPa can be seen in Table 5.

The first embodiment corresponds to the No. 1 alloy, the second embodiment corresponds to the No. 2 alloy, and the rest can be deduced accordingly. In order to facilitate the comparison, the No. 8 alloy and the No. 9 alloy are used as the prior-art comparative materials. Among them, the No. 8 alloy is the weldable superalloy GH3230, which has the highest service temperature, and is extensively used for the high-temperature components of the combustion chambers of aerospace engines, and the No. 9 alloy is HTE alloy, which is currently the best material for ethylene cracking furnace tubes in the field of petrochemistry.

The oxidation-resistant heat-resistant alloys of the first to seventh embodiments are prepared by using the following method:

Step 1: weighing the raw materials;

Step 2: placing the electrolytic nickel, the pure iron and part of the graphite into the crucible of a non-vacuum intermediate-frequency smelting furnace that has fixed-point casting function, and obtaining a molten steel after being completely molten;

Step 3: heating up the molten steel to the refining temperature, and adding the remaining graphite;

Step 4: adding a certain amount of the mixed rare earth;

Step 5: adding a certain amount of the slag containing CaO;

Step 6: introducing flowing argon to the top surface of the casting runner, placing active elements such as metal aluminum, sponge hafnium, sponge titanium, sponge zirconium and metal yttrium into the casting runner, and when the chemical composition of the molten steel in Step 2 are qualified, and the temperature of the molten steel has risen to the pouring temperature, casting the molten steel into the casting runner from the opening at the top of the casting runner, and introducing the molten steel into the tundish from the opening at the bottom of the casting runner for the centrifugal casting; and (7) casting the centrifuge tube: quickly casting the molten steel in the tundish into a metal mold that is rotating at a high speed, to make an experimental centrifuge tube.

TABLE 1

The preparation raw materials and contents of the elements of the first to seventh embodiments

| Alloy | Al | Cr | C | Ni | W | Ti | Hf | Zr | Y | V | O | N | S | Si | Fe |
|---|---|---|---|---|---|---|---|---|---|---|---|---|---|---|---|
| 1 | 4.5 | 25 | 0.32 | 32 | 4.5 | 0.05 | 0.05 | 0.05 | 0.15 | — | 0.001 | 0.035 | 0.001 | 0.4 | balance |
| 2 | 4.1 | 28 | 0.45 | 35 | 5 | 0.1 | 0.15 | 0.01 | 0.03 | — | 0.001 | 0.032 | 0.002 | 0.4 | balance |

TABLE 1-continued

The preparation raw materials and contents of the elements of the first to seventh embodiments

| Alloy | Al | Cr | C | Ni | W | Ti | Hf | Zr | Y | V | O | N | S | Si | Fe |
|---|---|---|---|---|---|---|---|---|---|---|---|---|---|---|---|
| 3 | 3.7 | 26 | 0.43 | 44 | 5.7 | 0.11 | 0.05 | 0.05 | 0.05 | — | 0.001 | 0.038 | 0.002 | 0.33 | balance |
| 4 | 3.8 | 28 | 0.35 | 46 | 5 | 0.18 | 0.39 | 0.05 | 0.01 | — | 0.001 | 0.038 | 0.001 | 0.4 | balance |
| 5 | 2.9 | 27 | 0.41 | 49 | 7.8 | — | 0.15 | 0.03 | 0.18 | 0.01 | 0.001 | 0.002 | 0.001 | 0.2 | balance |
| 6 | 2.5 | 27 | 0.4 | 45 | 2 | — | 0.1 | 0.19 | 0.1 | 0.09 | 0.001 | 0.03 | 0.001 | 0.16 | balance |
| 7 | 5.9 | 29.5 | 0.5 | 35 | 3.1 | — | 0.05 | 0.04 | 0.02 | 0.2 | 0.001 | 0.03 | 0.001 | 0.3 | balance |

TABLE 2

Process parameters of the embodiments of the present disclosure

| Embodiment serial number | Refining temperature/° C. | Addition amount of mixed rare earth/% | Slag addition amount/% | Pouring temperature/° C. | Argon pressure/MPa | Argon flow rate/L/min | Casting speed/kg/min |
|---|---|---|---|---|---|---|---|
| 1-2 | 1640 | 0.15 | 4 | 1750 | 0.25 | 5 | 80 |
| 3-5 | 1680 | 0.25 | 3 | 1650 | 0.15 | 1 | 100 |
| 6-7 | 1660 | 0.05 | 5 | 1700 | 0.3 | 3.5 | 60 |

Under the same experimentation conditions, the peeling amounts after oxidation at different temperatures for 100 h of the alloys of the embodiments of the present disclosure and the two alloys in the prior art are individually measured, the experiment results of which are listed in Table 3. The states of intactness of the oxidation films after oxidation at different temperatures for 100 h are listed in Table 4, the high-temperature endurance properties are listed in Table 5, and the high-temperature tensile elongations of the alloys of the embodiments of the present disclosure are listed in Table 6.

TABLE 3

The peeling amounts of the alloys of the embodiments of the present disclosure and the comparative materials after oxidation at different temperatures for 100 h (mg/cm$^2$)

| Test temperature/° C. | No. 3 alloy | No. 9 alloy |
|---|---|---|
| 1000 | 0.04 | 0.07 |
| 1050 | 0.035 | 0.10 |
| 1100 | 0.024 | 0.26 |
| 1150 | 0.064 | 0.35 |
| 1200 | 0.077 | 2.09 |

TABLE 4

The ratios of the areas of aluminum oxides to the surfaces of the alloys after oxidation at different temperatures for 100 h

| Test temperature/° C. | 1100 | 1150 | 1200 |
|---|---|---|---|
| No. 1 alloy | 94% | 91% | 90% |
| No. 2 alloy | 95% | 93% | 93% |
| No. 3 alloy | 96% | 93% | 92% |
| No. 4 alloy | 96% | 93% | 92% |
| No. 5 alloy | 94% | 92% | 91% |
| No. 6 alloy | 95% | 94% | 92% |
| No. 7 alloy | 96% | 94% | 93% |
| No. 9 alloy | 80% | 70% | 25% |

Note:
the No. 8 alloy cannot form an aluminum-oxide film at the high temperature of 1150° C., so the table does not have the data of the No. 8 alloy.

TABLE 5

The endurance lives of the alloys at 1100° C./17 MPa

| Alloy | 1 | 2 | 3 | 4 | 5 | 6 | 7 | 8 | 9 |
|---|---|---|---|---|---|---|---|---|---|
| Endurance life/h | 95 | 98 | 111 | 99 | 120 | 97 | 92 | 40 | 11, 27, 53 |

TABLE 6

The tensile elongations of the alloys of the present disclosure at 1000° C.

| Alloy | 1 | 2 | 3 | 4 | 5 | 6 | 7 |
|---|---|---|---|---|---|---|---|
| Tensile elongation/% | 41 | 43 | 46 | 46 | 40 | 49 | 45 |

It can be known from FIG. 1 that, as analyzed in terms of the oxidation weight-gaining speeds, the oxidation resistances at 1100° C. of the alloy materials of the embodiments of the present disclosure are 2.5-4 times of that of the prior-art comparative material No. 8 alloy. At above 1100° C., the No. 8 alloy cannot form a continuous and stable oxidation film, and the oxidability sharply declines.

Figure 2:
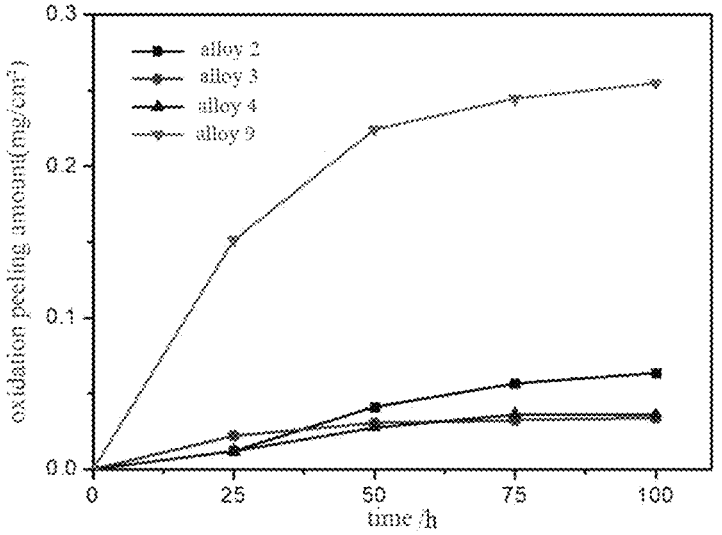
FIG. 2 is the cyclic-oxidation peeling curves at 1100° C. of the alloys of embodiments of the present disclosure and the comparative material No. 9 alloy.
Figure 3:
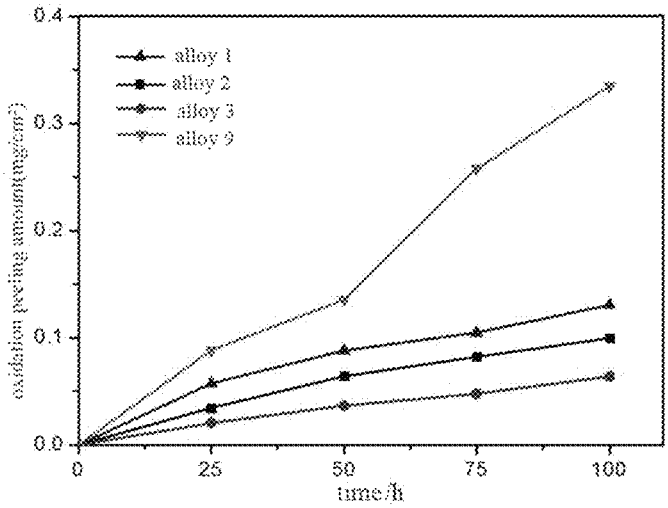
FIG. 3 is the cyclic-oxidation peeling curves at 1150° C. of the alloys of embodiments of the present disclosure and the comparative material No. 9 alloy.
Figure 4:
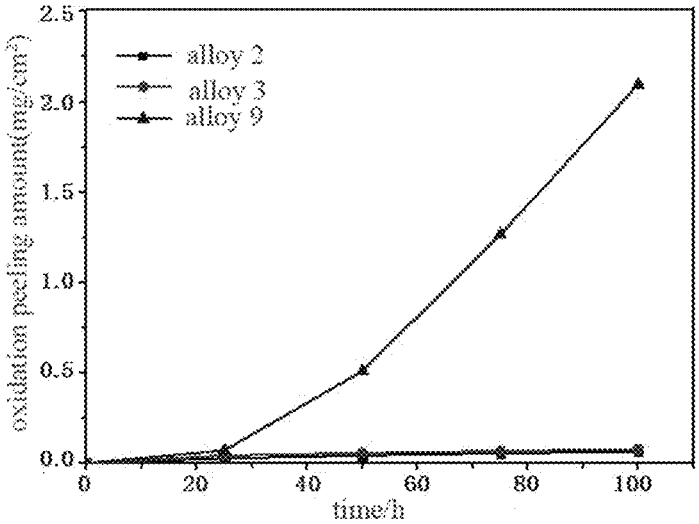
FIG. 4 is the cyclic-oxidation peeling curves at 1200° C. of the alloys of embodiments of the present disclosure and the comparative material No. 9 alloy.

It can be known from Table 3, FIG. 2, FIG. 3 and FIG. 4 that, in the temperature range of 1000-1200° C., along with the increasing of the oxidation temperature, the amplitudes of the increasing of the peeling amounts of the alloys of the present disclosure are very small, which indicates that all of the alloys of the present disclosure have an excellent oxidation resistance at below 1200° C. However, the oxidation resistance of the comparative material No. 9 alloy rapidly declines along with the increasing of the temperature, and particularly at above 1150° C. the amplitude of the declining of the oxidation resistance is particularly significant, wherein after oxidation for 100 h, the oxidation temperature increases from 1150° C. to 1200° C., and the oxidation peeling amount increases by 5 times. After cyclic oxidation at 1100° C. for 100 h, the oxidation peeling amount of the prior-art comparative material No. 9 alloy is 5-10 times of those of the alloy materials of the embodiments of the present disclosure, and after cyclic oxidation at 1200° C. for 100 h, the oxidation peeling amount of the prior-art comparative material No. 9 alloy is 27 times of those of the alloy materials of the embodiments of the present disclosure. That indicates that the cohesions between the oxidation film and the matrix of the alloys of the embodiments of the present disclosure are far greater than the cohesion between the oxidation film and the matrix of the No. 9 alloy, and, if the temperature is higher, the advantage of the alloys of the present disclosure is more obvious.

Figure 5:
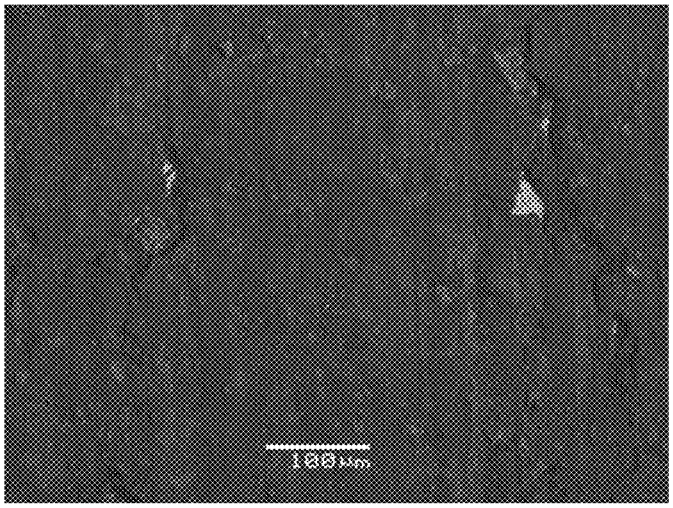
FIG. 5 is the scanning electron microscope photograph of the surface oxidation film of the No. 3 alloy of an embodiment of the present disclosure after cyclic-oxidation at 1200° C. for 100 h.
Figure 6:
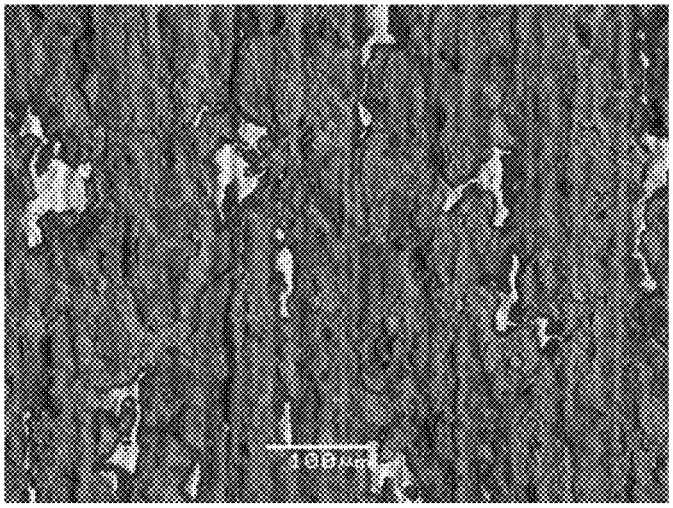
FIG. 6 is the scanning electron microscope photograph of the surface oxidation film of the comparative No. 9 alloy after cyclic-oxidation at 1200° C. for 100 h.

By further analyzing the states of the oxidation films formed at the surfaces after the alloy oxidation, it can be known (see Table 4, FIG. 5 and FIG. 6) that, in the alloys of the present disclosure, after oxidation in high-temperature environments at below 1200° C. for 100 h, aluminum oxide accounts for above 90% of the oxidation films formed at the surfaces of the samples, and the oxidation films are continuous and compact. Moreover, along with the increasing of the temperature, the aluminum-oxide film is substantially not reduced, and at 1200° C. still maintains above 90%. The stability of aluminum oxide at high temperature is very good, the compact aluminum-oxide films can protect the alloy matrixes from further oxidation, and if used in ethylene cracking furnace tubes, the aluminum-oxide films can have good carburization resistance function and coking resistance function. However, in the prior-art comparative material No. 9 alloy, aluminum oxide accounts for 80% of the oxidation film formed after oxidation at 1100° C. for 100 h. After the test temperature is increased to 1150° C., the aluminum oxide in the oxidation film decreases to 70%, and after the test temperature is further increased to 1200° C., the aluminum oxide in the oxidation film sharply decreases to 25%, along with a large amount of oxidation film peeling. That indicates that, at above 1100° C., the advantage of the oxidation resistances of the alloys of the present disclosure over those of the prior-art materials gradually enlarges, and if the temperature is higher, the advantage is larger. In FIG. 5 and FIG. 6, the white areas are the peeling area, the black areas are the aluminum-oxide film, and the grey-white areas are the composite oxidation film.

Figure 7:
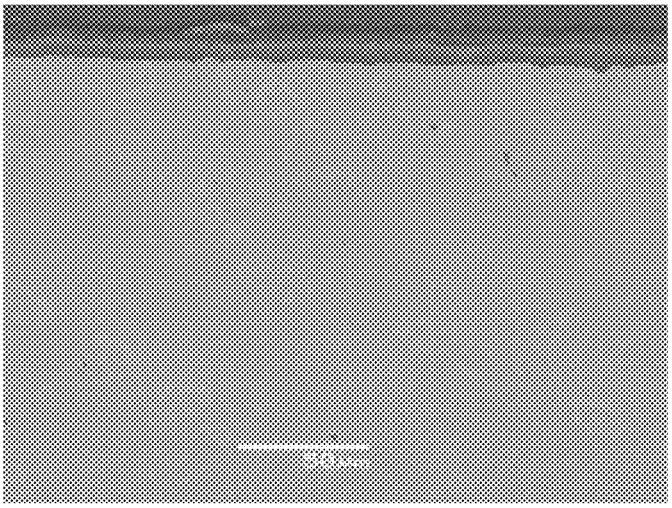
FIG. 7 is the section scanning electron microscope photograph of the oxidation film of the No. 3 alloy of an embodiment of the present disclosure after cyclic-oxidation at 1200° C. for 100 h.
Figure 8:
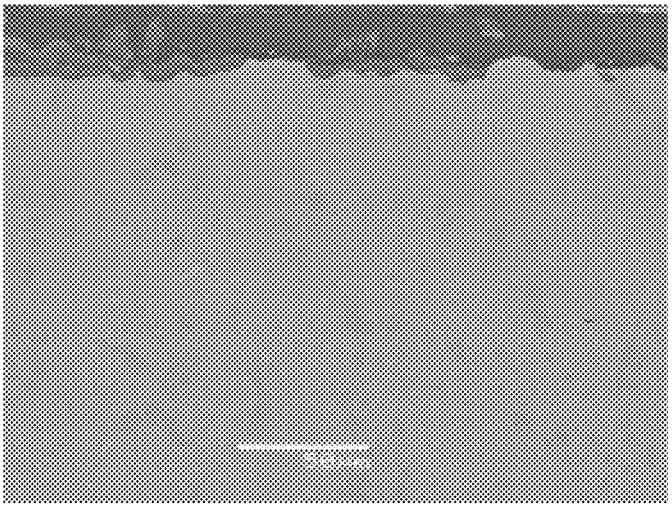
FIG. 8 is the section scanning electron microscope photograph of the oxidation film of the comparative No. 9 alloy after cyclic-oxidation at 1200° C. for 100 h.

By further observing the sections of the oxidation films formed after cyclic oxidation at 1200° C. for 100 h (see FIG. 7 and FIG. 8), it is found that, the oxidation film formed by the alloy of the embodiment of the present disclosure is continuous and compact, cohere closely with the matrix, has a regular cohering interface, and has an oxidation film thickness of approximately 6 μm, while the oxidation film of the prior-art comparative material No. 9 alloy is discontinuous and loose, has a non-compact cohesion between the residual oxidation film and the matrix, has an irregular cohering interface, has obvious peeling, and has a residual oxide layer thickness of approximately 3 μm. By comparing the two oxidation films, the protection effect of the oxidation film formed by the material of the present disclosure to the alloy matrix is obviously better than that of the prior-art comparative material No. 9 alloy.

As assessed according to HB5258-2000 (Experimental Method for Measurement of Oxidation Resistance of Steel and Superalloys), the complete-oxidation-resistance-level temperatures of the alloys of the embodiments of the present disclosure reach 1200° C., while the complete-oxidation-resistance-level temperature of the prior-art comparative material No. 9 alloy is only 1050° C. The complete-oxidation-resistance-level temperatures of the alloys of the present disclosure are higher by 150° C. than that of the conventional alloys. Regarding the technical field of alloys, when the temperature is above 1000° C., particularly at above 1100° C., because of the poor stability of the oxidation film and the poor cohesion between the matrix and the oxidation film, the oxidation resistances of the alloys sharply decline. For example, for the No. 9 alloy, which has a very excellent oxidation resistance in the prior art, when the test temperature is increased from 1150° C. to 1200° C., the proportion of aluminum oxide in the oxidation film decreases from 70% to 25%, and the oxidation film peeling amount increases by 5 times. At 1050° C., the No. 9 alloy belongs to the complete-oxidation-resistance level, at 1100° C. that declines to the oxidation-resistance level, and at 1200° C., that declines to the sub-oxidation-resistance level. A person skilled in the art knows well that, it is very difficult to improve the oxidation resistances of the alloys at above 1100° C., and each time the temperature is improved by 20° C. or 50° C., the increasing of such difficulty will be of exponential order. However, it can be deemed as a milestone in the field of oxidation-resisting alloys that the complete-oxidation-resistance-level temperature of the alloy of the present disclosure reaches 1200° C., which is realized by a high amount of experimentation for repeatedly adjusting the alloy composition and contents, and by continuously optimizing the process steps and the process parameters.

It can be known from Table 5 that, the endurance lives at 1100° C./17 MPa of the alloy materials of the embodiments of the present disclosure are 2.4-3 times of that of the prior-art comparative material No. 8 alloy. The 11, 27 and 53 in Table 5 indicate that, the endurance lives of the three No. 9 alloy tubes are different from each other, and the differences among the endurance lives of the alloy tubes are large, which indicates that the quality stability of the No. 9 alloy is poor, and the property difference of different tubes is large, which also indicates that the overall quality of the No. 9 alloy is low. However, the differences among the endurance lives of the multiple alloy tubes of the same embodiment of the present disclosure do not exceed 3 h, which indicates that the quality stability of the alloys of the embodiments of the present disclosure is good, and the overall quality of the alloys of the embodiments of the present disclosure is good. Accordingly, it can be seen that, the high-temperature mechanical properties of the materials of the present disclosure are obviously better than those of the No. 8 alloy and the No. 9 alloy, and the quality stability of the alloys of the embodiments of the present disclosure is better than that of the No. 9 alloy.

It can be known from Table 6 that, the tensile elongations at 1000° C. of the alloys of the present disclosure are 40%-50%, which indicates that, when the aluminum contents are high, the toughness of the alloys of the present disclosure is still good.

In conclusion, the oxidation-resistant heat-resistant alloy of the present disclosure has the advantages such as higher service temperature, more excellent high-temperature oxidation resistance, more compact oxidation film formed, larger area of aluminum-oxide film, and better high-temperature mechanical property, and the oxidation-resistant heat-resistant alloy of the present disclosure can serve at below 1200° C. for a long term and stably, can form an aluminum-oxide film of above 90% in oxidizing atmospheres at 1000-1200° C., belongs to complete-oxidation-resistance level at below 1200° C. according to HB5258-2000, and is superior to conventional weldable high-temperature materials.

The alloy of the present disclosure has a very excellent comprehensive property, and besides being capable of being used to cast ethylene cracking furnace tubes, can also be used to cast other castings that are required to serve at high temperature, especially castings that are required to serve in severe environments of 1100-1200° C. high temperatures and high oxidability.

The above are merely preferable particular embodiments of the present disclosure, and the protection scope of the present disclosure is not limited thereto. All of the variations or substitutions that a person skilled in the art can easily envisage within the technical scope disclosed by the present disclosure should fall within the protection scope of the present disclosure.

What is claimed is:

1. An oxidation-resistant heat-resistant alloy, by mass percentage, consisting of: 2.5%-6% of Al, 24%-30% of Cr, 0.3%-0.55% of C, 30%-50% of Ni, 2%-8% of W, 0.01%-0.2% of Ti, 0.01%-0.2% of Zr, 0.01%-0.4% of Hf, 0.01%-0.2% of Y, and 0.01%-0.2% of V; wherein merely one of Ti and V is comprised;

wherein the alloy comprises: N<0.05%, O<0.003%, S<0.003%, and Si<0.5%, the balance being Fe and inevitable impurities;

wherein in an oxidizing atmosphere of 1000-1200° C., no less than 90% of an area of an oxidation film that is formed at a surface of the alloy is an $Al_2O_3$ film.

2. The oxidation-resistant heat-resistant alloy according to claim 1, wherein the alloy comprises: 3.3%-5.5% of Al, and 34%-46% of Ni.

3. The oxidation-resistant heat-resistant alloy according to claim 1, wherein the alloy comprises: 3%-6% of W.

4. The oxidation-resistant heat-resistant alloy according to claim 1, wherein the alloy comprises: 0.01%-0.06% of Y.

* * * * *